US008813981B2

(12) United States Patent
Ethington

(10) Patent No.: US 8,813,981 B2
(45) Date of Patent: Aug. 26, 2014

(54) ANTI-TWO BLOCK SYSTEM FOR A CRANE ASSEMBLY

(75) Inventor: Brad G. Ethington, Rudd, IA (US)

(73) Assignee: Oshkosh Corporation, Oshkosh, WI (US)

( * ) Notice: Subject to any disclaimer, the term of this patent is extended or adjusted under 35 U.S.C. 154(b) by 347 days.

(21) Appl. No.: 13/425,111

(22) Filed: Mar. 20, 2012

(65) Prior Publication Data

US 2012/0241403 A1 Sep. 27, 2012

Related U.S. Application Data

(60) Provisional application No. 61/465,546, filed on Mar. 21, 2011.

(51) Int. Cl.
*B66C 13/18* (2006.01)

(52) U.S. Cl.
USPC ..... 212/281; 212/276

(58) Field of Classification Search
CPC ..... B66C 13/50; B66C 13/00; B66C 13/18; B66C 23/90; B66C 23/905
USPC ..... 212/281, 276
See application file for complete search history.

(56) References Cited

U.S. PATENT DOCUMENTS

| | | | | |
|---|---|---|---|---|
| 3,969,714 | A | 7/1976 | Greer | |
| 4,067,447 | A | 1/1978 | Goss et al. | |
| 4,170,308 | A | 10/1979 | Rogers | |
| 4,280,628 | A * | 7/1981 | Goss et al. | 212/281 |
| 4,300,134 | A | 11/1981 | Paciorek | |
| 5,263,660 | A * | 11/1993 | Brozik | 254/269 |
| 6,068,145 | A | 5/2000 | Luke | |
| 6,343,703 | B1 * | 2/2002 | Fleagle et al. | 212/281 |
| 6,843,383 | B2 | 1/2005 | Schneider et al. | |
| 2008/0302750 | A1 * | 12/2008 | Worboys | 212/281 |

* cited by examiner

*Primary Examiner* — Emmanuel M Marcelo
(74) *Attorney, Agent, or Firm* — Foley & Lardner LLP

(57) ABSTRACT

A crane assembly includes an anti-two block system having a rigid body, a sensor configured to detect upward loading of the body, and a spring biasing the body to a pin of a sheave. The body includes a base, two extensions projecting perpendicularly upward from the base and extending outside the sheave on opposite sides thereof, and a fitting on upper ends of the extensions. The fitting couples to the pin of the sheave such that the body is configured to rotate about the pin. The crane assembly further includes a controller comprising logic configured to prevent movement of a hook in response to a signal from the sensor of the anti-two block system. The weight of the body of the anti-two block system rotates the body such that the extensions are substantially aligned with a cable between an end of a boom and a hook as the boom rotates.

20 Claims, 16 Drawing Sheets

ANTI-TWO BLOCK SYSTEM FOR A CRANE ASSEMBLY

CROSS-REFERENCE TO RELATED PATENT APPLICATIONS

This application claims priority to and the benefit of U.S. Provisional Application No. 61/465,546, filed Mar. 21, 2011, which is incorporated herein by reference in its entirety.

BACKGROUND

The present invention relates generally to the field of cranes and other lifting machines designed to raise, lower, load, unload, or otherwise move cargo, materials, and other items. More specifically the present invention relates to an anti-two block system for use with a crane assembly.

A crane typically includes a main body or platform and a boom extending from the main body. The main body may be fixed or mobile. The boom supports a cable, which may be formed from metal wire, chains, rope, or other materials. A hoist or winch is used to wind and unwind the cable. The crane further includes a hook or other tool hanging from the end of the boom opposite to the main body by the cable. The hook is generally used to attach cargo, materials, or other items to the cable of the crane.

The sizes, loads, and forms of crane assemblies vary widely. In some cases, a boom includes stages of extensions that slide telescopically from one another. The number of stages varies, and may include a main section with two or more extensions. In other cases, the boom includes a jib pivotally fastened to an end of the boom, to increase the length of the boom. The jib may also include telescoping sections. In still other cases, the boom extends from the main body of the crane by way of an articulated arm that maneuvers the boom.

SUMMARY

According to one exemplary embodiment, a crane assembly includes a boom, a cable, and a hook coupled to an end of the boom by the cable on a sheave. The crane assembly is configured for lifting items via the hook. The crane assembly also includes an anti-two block system that includes a body that is rigid, a sensor configured to detect upward loading of the body of the anti-two block system relative to a portion of the end of the boom, and a spring biasing the body of the anti-two block system to a pin of the sheave. The body includes a base having a surface for receiving the hook, two extensions projecting upward from the base, perpendicular thereto, wherein the extensions extend outside the sheave on opposite sides thereof, and a fitting on upper ends of the extensions, wherein the fitting couples to a pin of the sheave such that the body is configured to rotate about the pin that the sheave rotates about. The crane assembly further includes a controller comprising logic configured to prevent movement of the hook in response to a signal from the sensor of the anti-two block system. The weight of the body of the anti-two block system rotates the body such that the extensions are substantially aligned with the cable between the end of the boom and hook as the boom rotates.

According to another exemplary embodiment, a crane assembly includes a boom, a cable, and a hook coupled to an end of the boom by the cable on a sheave, wherein the crane assembly is configured for lifting items via the hook. The crane assembly also includes an anti-two block system, that includes a rigid body. The rigid body includes a base, a pair of extensions projecting perpendicularly upward from the base, wherein the extensions extend outside the sheave on opposite sides thereof, and a fitting on upper ends of the extensions, wherein the fitting couples to a pin of the sheave such that the body is configured to rotate about the pin. The anti-two block system also includes a sensor configured to detect upward loading of the body of the anti-two block system relative to a portion of the end of the boom, and a spring biasing the body of the anti-two block system to the pin. The weight of the body of the anti-two block system rotates the body such that the extensions are substantially aligned with the cable between the end of the boom and hook as the boom rotates.

According to another exemplary embodiment, a crane assembly includes an anti-two block system including a rigid body, a sensor configured to detect upward loading of the body of the anti-two block system relative to an end of a boom, and a spring biasing the body of the anti-two block system to a pin of a sheave of the boom. The body includes a base, a pair of extensions projecting perpendicularly outward from the base, wherein each extension is configured to extend outside a side of a sheave of a boom of the crane assembly, and a fitting on an upper end of each of the extensions, wherein the fitting couples to a pin of the sheave such that the body is configured to rotate about the pin. The weight of the body of the anti-two block system rotates the body such that the extensions are substantially aligned with a cable of the crane assembly between the end of the boom an a hook of the crane assembly as the boom rotates.

BRIEF DESCRIPTION OF THE FIGURES

The disclosure will become more fully understood from the following detailed description, taken in conjunction with the accompanying figures, in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
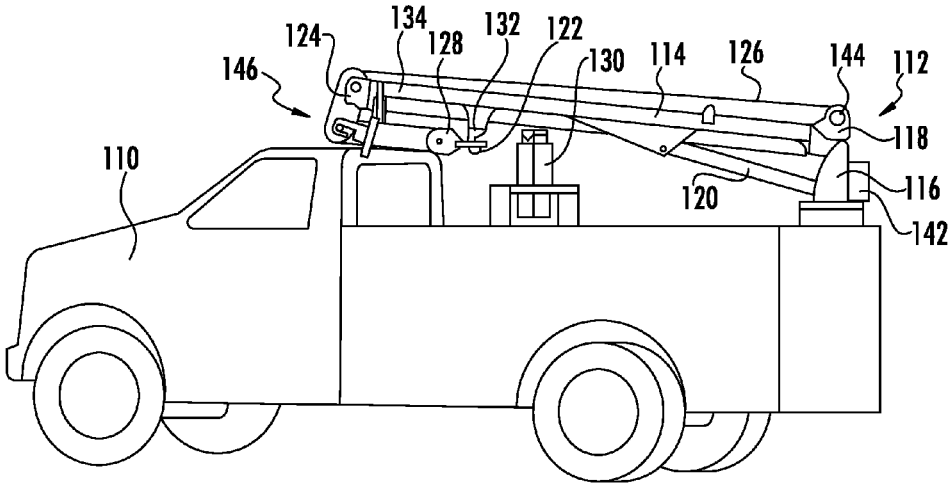
FIG. 1 is a perspective view of a utility vehicle having a telescoping crane in a first configuration according to an exemplary embodiment of the invention.

Referring to FIG. 1, a utility vehicle 110, such as mobile crane or mechanics truck, includes a crane assembly 112. The crane assembly 112 includes a boom 114 extending from a main body in the form of a mast 116 of the crane assembly 112. The mast 116 is coupled to the chassis of the utility vehicle 110. The boom 114 is coupled to the mast 116 by way of a pivot 118 (e.g., fulcrum, joint, pin), allowing the boom 114 or mast 116 to rotate about a vertical axis generally orthogonal to the chassis of the utility vehicle 110.

According to an exemplary embodiment, an actuator, such as an electric or hydraulic motor driving a planetary- or worm-gear set, is integrated with or coupled to the mast 116 and configured to rotate the boom 114 or the mast 116 relative to the main body of the utility vehicle 110. An actuator 120, such as a linear actuator or hydraulic cylinder (e.g., "main cylinder") extending between the boom 114 and the mast 116, is configured to raise and lower the boom 114 in a controlled manner by increasing or decreasing the angle of the boom 114 about the pivot 118 relative to a horizontal axis generally coplanar with the chassis of the utility vehicle 110.

According to an exemplary embodiment, the crane assembly 112 further includes a hook 122 coupled to an end 124 of the boom 114 opposite to the mast 116 by way of a cable 126. The hook 122 is maneuverable by moving the utility vehicle 110, rotating the boom 114, raising or lowering the boom 114, and winding or unwinding the cable 126. In some embodiments, the hook 122 is fastened to a block 128 (e.g., snatch block) having one or more sheaves for a pulley system that provides a mechanical advantage as the cable 126 raises and lowers the block 128. The hook 122 generally forms a loop upon which items, fasteners, or the cable 126 itself may be configured to fasten cargo, construction materials, or other items to the crane assembly 112, in order to move the items. In other contemplated embodiments, the crane assembly 112 includes a loop, a ball, chains, a platform, a sprayer, or other tools coupled to the end 124 of the boom 114, such as by way of the cable 126.

The crane assembly 112 in FIG. 1 is shown in a storage configuration, with the boom 114 lowered and retracted, supported by a rest 130 (e.g., boom support, stand, seat, post). The hook 122 is stored on a projection 132 extending from the underside of the boom 114. An anti-two block system 146 is configured to be automatically stored (e.g., "self-stow") with the hook 122, block 128, and cable 126. Rotation of the hook 122 and cable 126 rotates the anti-two block system into the storage configuration, which is then held in place by the cable 126 supported by the hook 122 on the projection 132. In the storage configuration, the utility vehicle 110 is configured to drive the crane assembly 112 to or from a worksite, where the crane assembly 112 may be converted to an operational configuration (see FIGS. 2 and 4).

Figure 2:
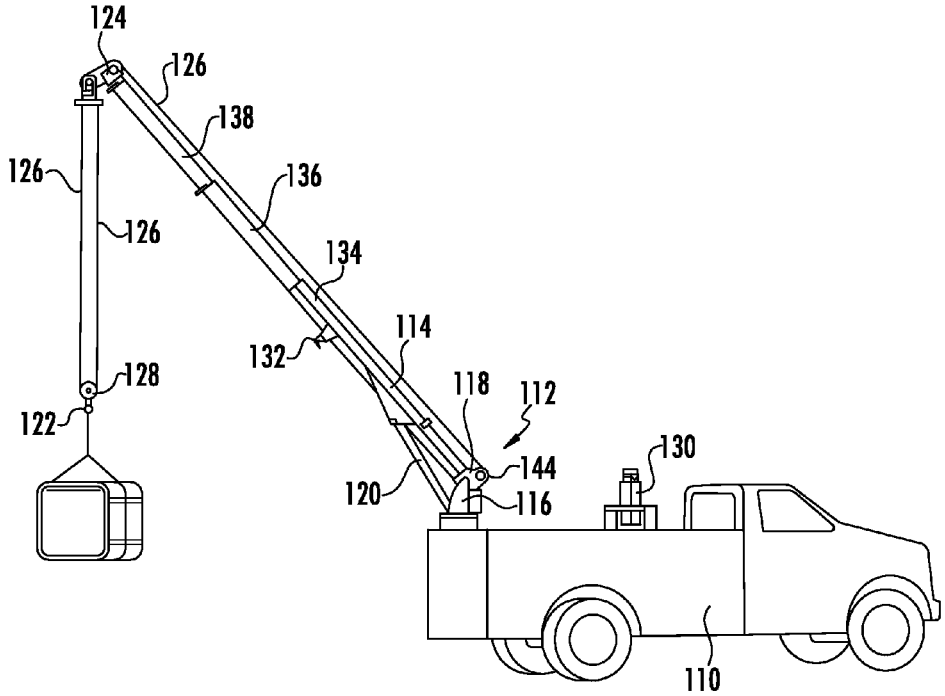
FIG. 2 is a perspective view of the utility vehicle of FIG. 1 with the telescoping crane in a second configuration.
Figure 4:
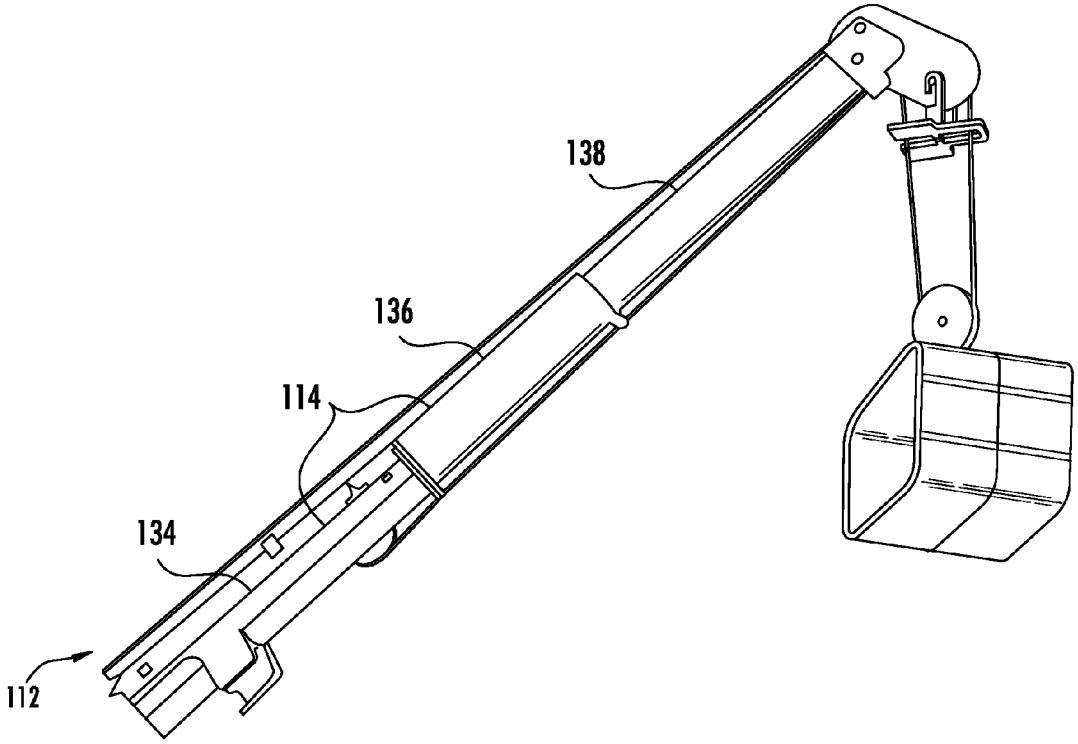
FIG. 4 is a perspective view of a boom supporting a load according to an exemplary embodiment of the invention.

Referring now to FIG. 2, the crane assembly 112 is shown in an operational configuration (see also FIG. 4). According to an exemplary embodiment, the boom 114 includes a main section 134 (e.g., main boom) and first- and second-stage extensions 136, 138. The first-stage extension 136 is configured to telescope outward from the main section 134, and the second-stage extension 138 is configured to telescope outward from the first-stage extension 136. Linear actuators, such as hydraulic cylinders (not shown), which may be located internal to the sections 134, 136, 138, slide the first-stage extension 136 relative to the main section 134 and the second-stage extension 138 relative to the first-stage extension 136. In contemplated embodiments, the crane assembly includes additional or fewer stages of telescoping extensions. In the operational configuration shown in FIG. 2, the boom 114 of the crane assembly 112 is at least partially extended or raised from the rest 130.

In contemplated embodiments, a crane assembly may include a boom and hook, without a mast. In some such embodiments, the boom is pivotally coupled to a main body other than a mast, such as a fixed platform or rig. In other such embodiments, the boom may be configured to be raised and lowered about a pinned pivot, but not rotated about a vertical axis. The apparatus of the present invention is not limited to a particular type of crane configuration.

Figure 3:
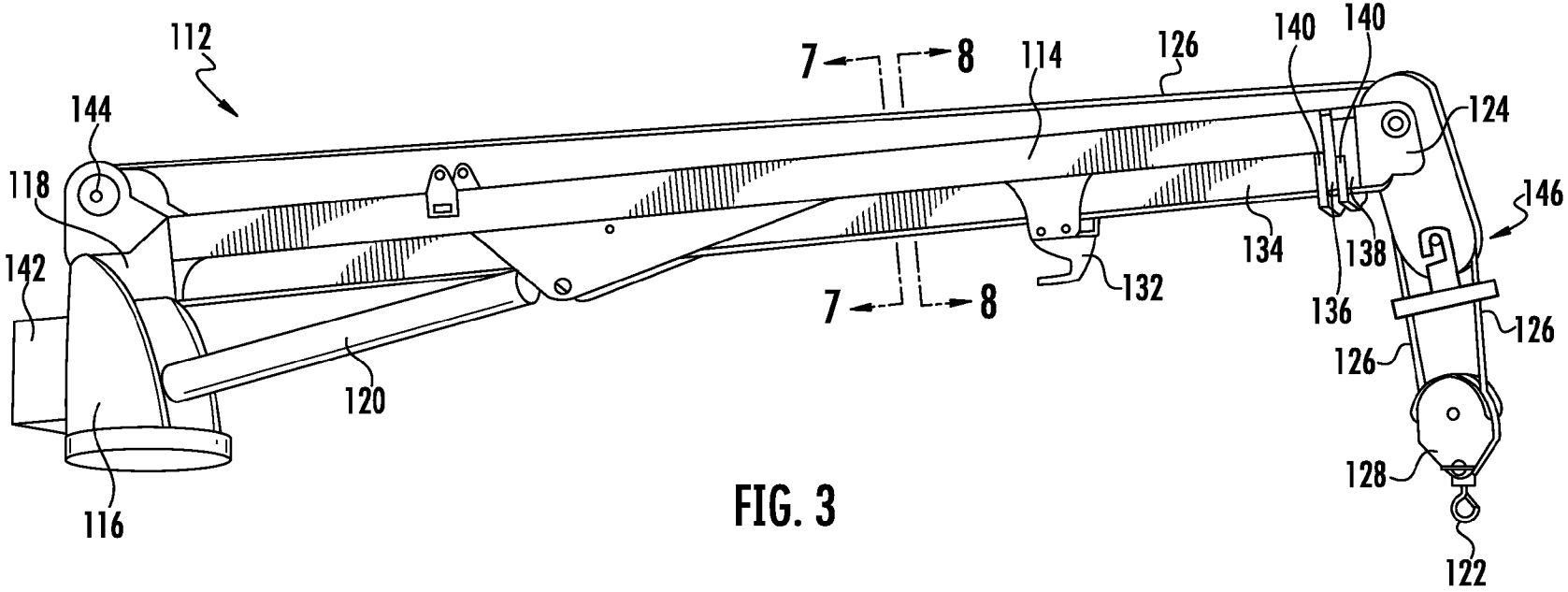
FIG. 3 is a perspective view of the telescoping crane of FIG. 1.

Referring to FIG. 3, the crane assembly 112 includes the boom 114 coupled to the mast 116 about the pivot 118. The boom 114 also includes stiffening plates 140 (e.g., stiffening collars) to reinforce the boom 114 along portions of the boom 114 that may receive increased stresses, such as ends of the sections 134, 136, 138. First- and second-stage extensions 136, 138 of the boom 114 are retracted in FIG. 3 in the storage configuration, where the second-stage extension 138 is telescopically nested within the first-stage extension 136 and the first-stage extension 136 is telescopically nested in the main section 134 of the boom 114. The projection 132 extends from the underside of the boom 114 for storage of the hook 122 and block 128.

According to an exemplary embodiment, a valve bank 142 is fastened to the mast 116 and coupled to the actuator 120 that raises and lowers the boom 114. In some embodiments, the valve bank 142 controls a flow of hydraulic fluid to and from the actuator 120, and to and from other hydraulic actuators of the crane assembly 112, such as those that may be used to rotate the boom 114 and extend the first- and second-stage extensions 136, 138. In contemplated embodiments, electric actuators or a power take-off from an engine may be used with or in place of hydraulic actuators for directly or indirectly moving the hook 122.

According to an exemplary embodiment, the cable 126 of the crane assembly 112 is at least partially wound on the spool of a hoist 144, which may be driven by a hydraulic motor. The cable 126 then extends along the top of the main section 134 of the boom 114 to the end 124 of the boom 114 opposite to the mast 116. In other contemplated embodiments, one or more cables extend through sections of the boom 114 or along a side of the boom 114 other than the top, or the hoist 144 is mounted to the end 124 of the boom 114 opposite to the mast 116.

In some embodiments, the end 124 of the boom 114, shown as the external or distal end of the second-stage extension 138 (e.g., "horse head") in FIG. 3, includes one or more sheaves about which the cable 126 extends. The cable 126 then extends to the block 128. According to an exemplary embodiment, the boom 114 includes an anti-two block system 146. The anti-two block system 146 is configured to stop the hoist 144 from winding the cable 126 too far such that the block 128 is pulled into the end 124 of the boom 114. Instead, an electro-mechanical switch stops the hoist 144, when the anti-two block system is activated. Direct or indirect contact of the block 128 with the switch on the end 124 of the boom 114 activates the system 146. Once activated, a controller (e.g., computer, control mechanism, processor (with or without memory), etc.) of the crane assembly 112 only allows for retracting of the extensions 136, 138 or 'winching down' (i.e., lowering) of the block 128 to release the block 128 from the end 124 of the boom 114.

Figure 5:
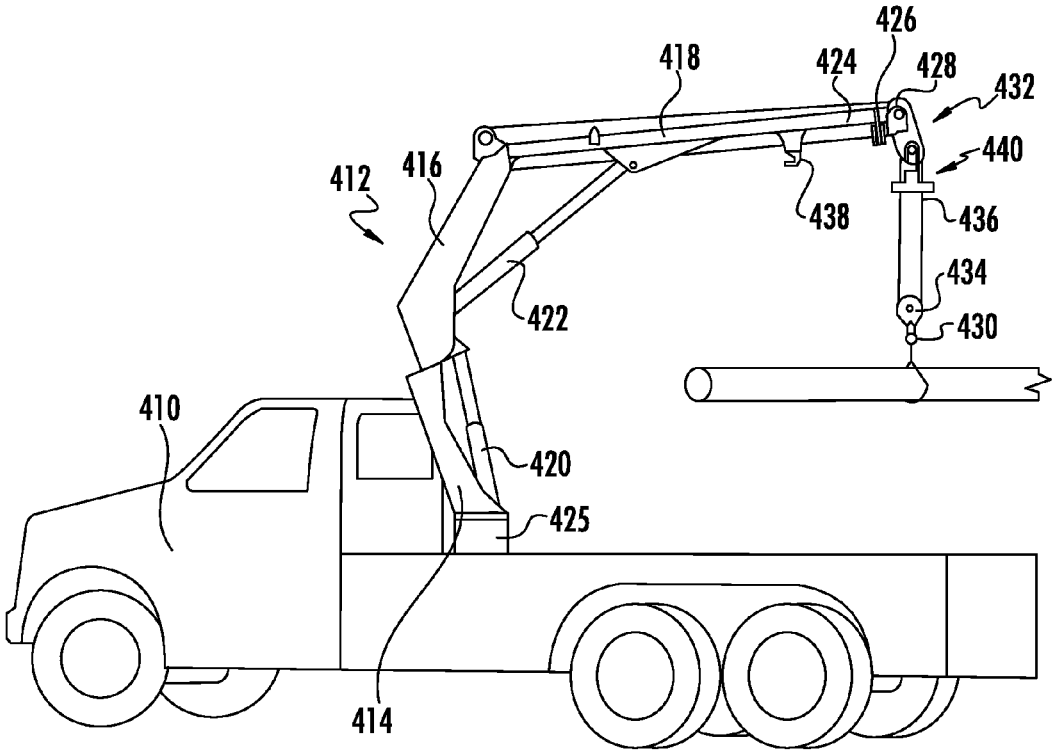
FIG. 5 is a perspective view of an articulated crane mounted on a vehicle according to an exemplary embodiment of the invention.

Referring to FIG. 5, a utility vehicle 410 includes an articulated crane assembly 412 (e.g., articulated arm) having a first segment 414, a second segment 416, and a third segment 418. The segments 414, 416, 418 are moved relative to one another by linear actuators, such as hydraulic cylinders 420, 422. A rotation system 425 coupled to the first segment 414 allows the first segment 414 to rotate relative to the chassis of the utility vehicle 410. The articulated crane assembly 412 may be configured to facilitate transport and construction applications.

According to an exemplary embodiment, the third segment 418 of the articulated crane assembly 412 includes a telescoping boom that includes a main section 424, a first-stage extension 426, and a second-stage extension 428, where the first- and second-stage extensions 426, 428 are nested within the main section 424. A hook 430 or other tool is coupled to a distal end 432 of the third segment 418 by way of a block 434 and cable 436. An anti-two block system 440 is integrated with the distal end 432. According to an exemplary embodiment, the main section 424 of the third segment 418 includes a projection 438 for stowing the hook 430.

Loading on the segments 414, 416, 418 of the articulated crane assembly 412 may differ from the loading of the boom 114 shown in FIGS. 1-3 because the articulated arrangement of the segments 414, 416, 418 allows the segments 414, 416, 418, particularly the second and third segments 416, 418, to be angled horizontally or even more than ninety degrees from vertical. As such, the distal end 432 has the potential to rotate over a wider range than the end 124 of the boom 114 of FIGS. 1-3.

Figure 6:
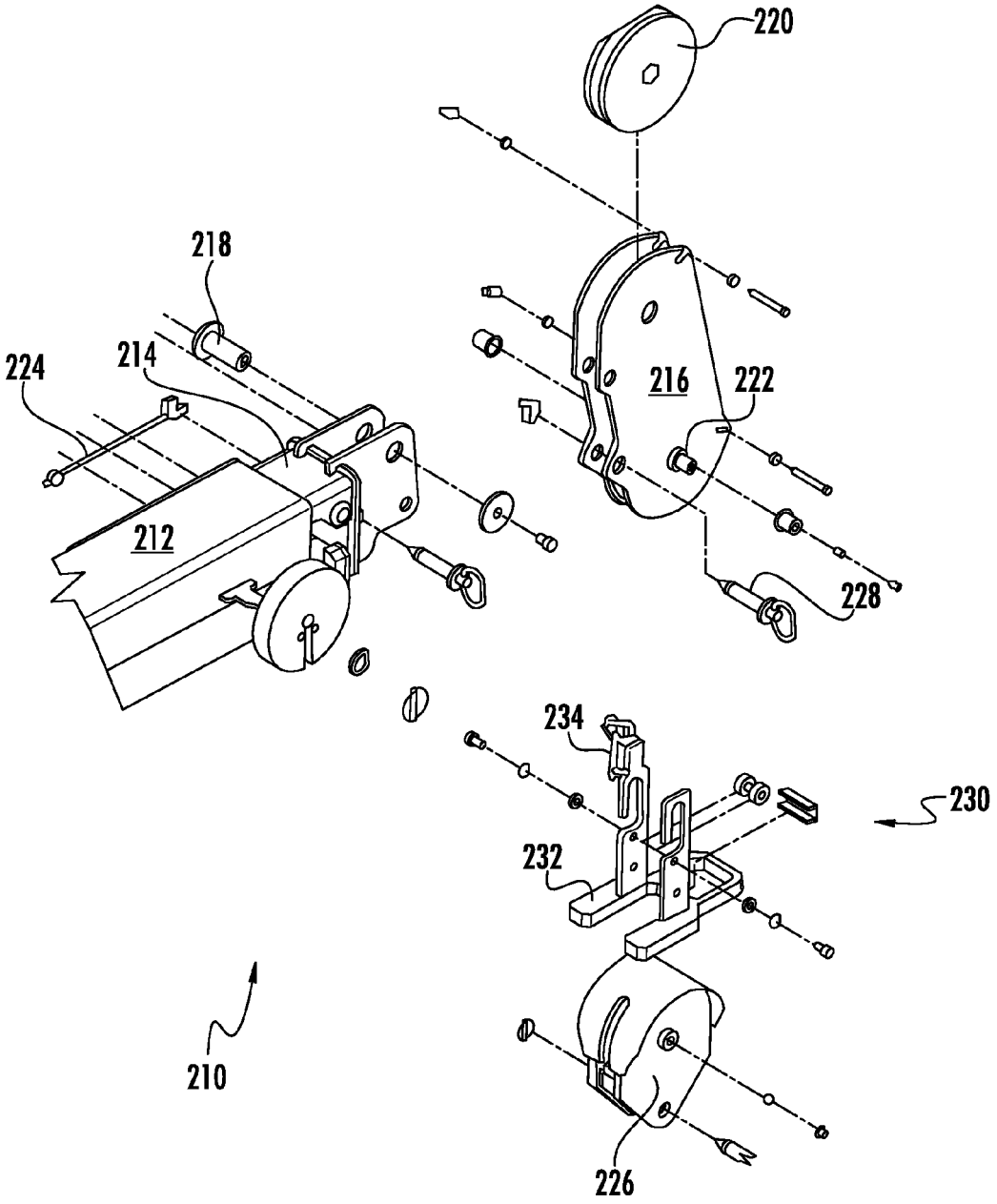
FIG. 6 is an exploded view of an end of a boom according to an exemplary embodiment of the invention.

Referring to FIG. 6, a crane assembly 210 includes a boom 212, which includes an extension 214 (e.g., second-stage extension, third-stage, telescoping extension) with a distal end 216 (e.g., horse head). The distal end 216 is fastened to the extension 214, such as by a pin 218 extending through openings in the extension 214 and distal end 216, or by other fasteners (e.g., bolts, welds). A sheave 220 for a pulley system is coupled to the distal end 216; and, in some embodiments, is supported within a frame or housing of the distal end 216. The sheave 220 is fastened such that the sheave 220 is free to rotate about a pin 222 (e.g., hub, axle).

According to an exemplary embodiment, a cable 224 extends from a hoist (see hoist 144 as shown in FIG. 3; e.g., winch, reel) to and about the sheave. The cable 224 then extends from the distal end 216 of the boom 212 to a snatch block 226 or other tool. The distal end 216 of the boom 212 may include more than one sheave, and the snatch block 226 may also include more than one sheave, depending upon the arrangement of the pulley system. According to an exemplary embodiment, the cable 224 extends back to the distal end 216 of the boom 212, where the cable 224 is anchored, such as by way of a pin 228 or bolt.

According to an exemplary embodiment, the crane assembly 210 includes an anti-two block system 230 (e.g., an A2B device), which may be located between the distal end 216 of the boom 212 and the snatch block 226. The anti-two block system 230 includes a body 232 and a sensor 234. According to an exemplary embodiment, the body 232 is substantially rigid and is integrally formed, or formed from a network (e.g., truss, framework) of rigid members (e.g., beams) fixed to one another, such as by welding, bolting, or other fasteners. In contemplated embodiments, a body of an anti-two block system is formed from rigid members that are moveable relative to each other, such as fastened together by way of a rotatable joint.

Figure 7:
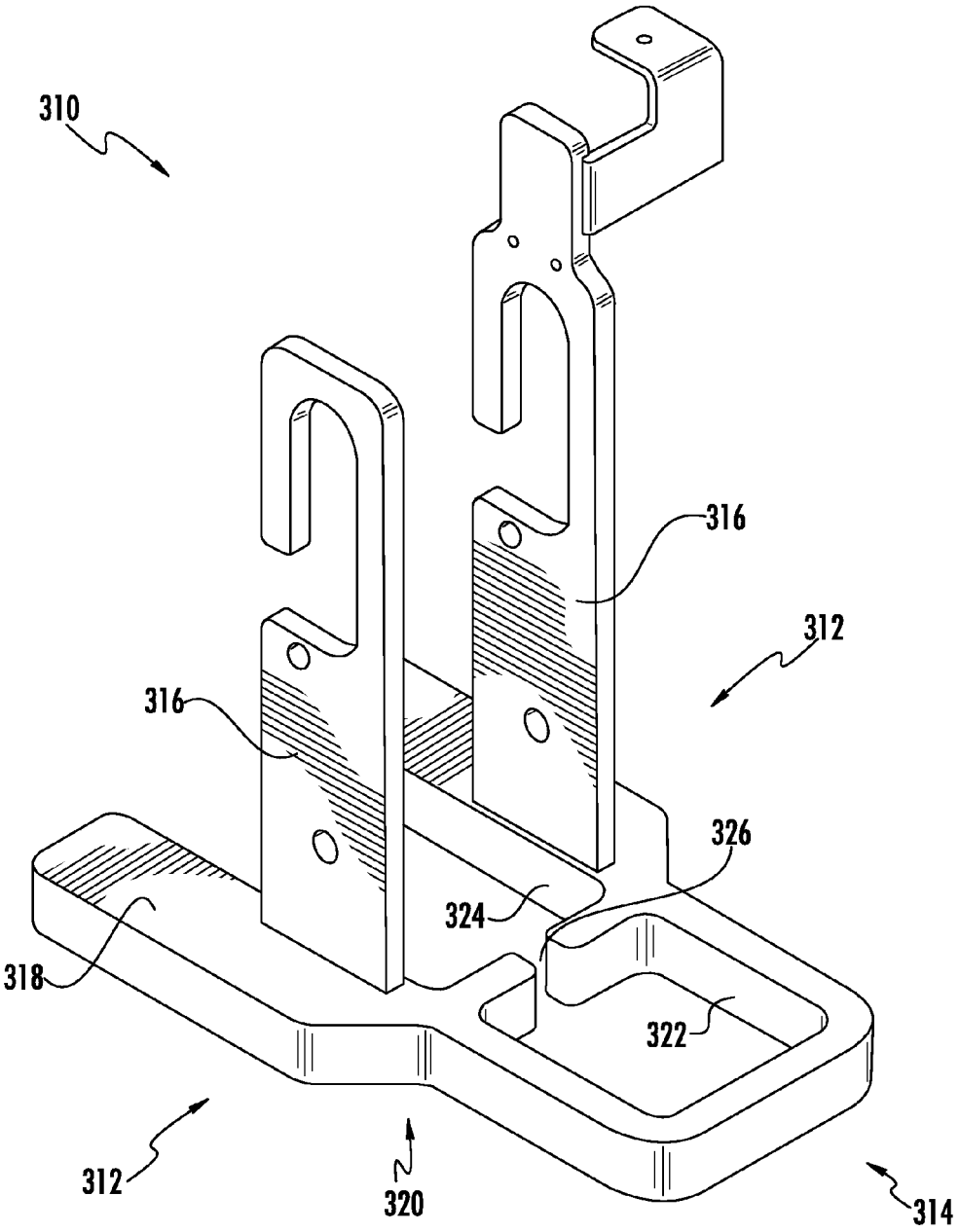
FIG. 7 is a perspective view of a portion of an anti-two block system according to an exemplary embodiment of the invention.

Referring to FIG. 7, according to an exemplary embodiment, a body 310 of an anti-two block system is a rigid member that is generally shaped like an inverted "T" when viewed from a side 312 of the crane assembly. When viewed from the front 314, the body 310 is generally shaped like a "U" with extensions 316 (e.g., legs, projections, vertical members, arms) projecting upward from a base 318 on opposite sides of the distal end of the boom (see, e.g., distal end 216 as shown in FIG. 6). When viewed from above or below 320, the body 310 is generally shaped like an "A" with a first opening 322 (e.g., space, aperture, guide) for the cable (see, e.g., cable 126 as shown in FIG. 3) going to the snatch block (see, e.g., snatch block 226 as shown in FIG. 6) and a second opening 324 for the cable returning to the distal end of the boom for anchoring. In some embodiments, the horizontal line of the "A" includes an opening 326 sized to allow the cable to fit through to the upper interior portion of the "A".

Use of the body 310 of the anti-two block system that is substantially rigid is intended to improve the reliability of the anti-two block system. When compared to anti-two block systems that use flexible members (e.g., chains, cables) to support a sensor, the substantially rigid body of FIG. 7 is less likely to fail due to wear, twist, getting caught with the cable or other parts of the crane assembly, warping, etc. However, in some contemplated embodiments, flexible members are used. For example, flexible members may be used with a light facing the snatch block in some contemplated embodiments.

Figure 9:
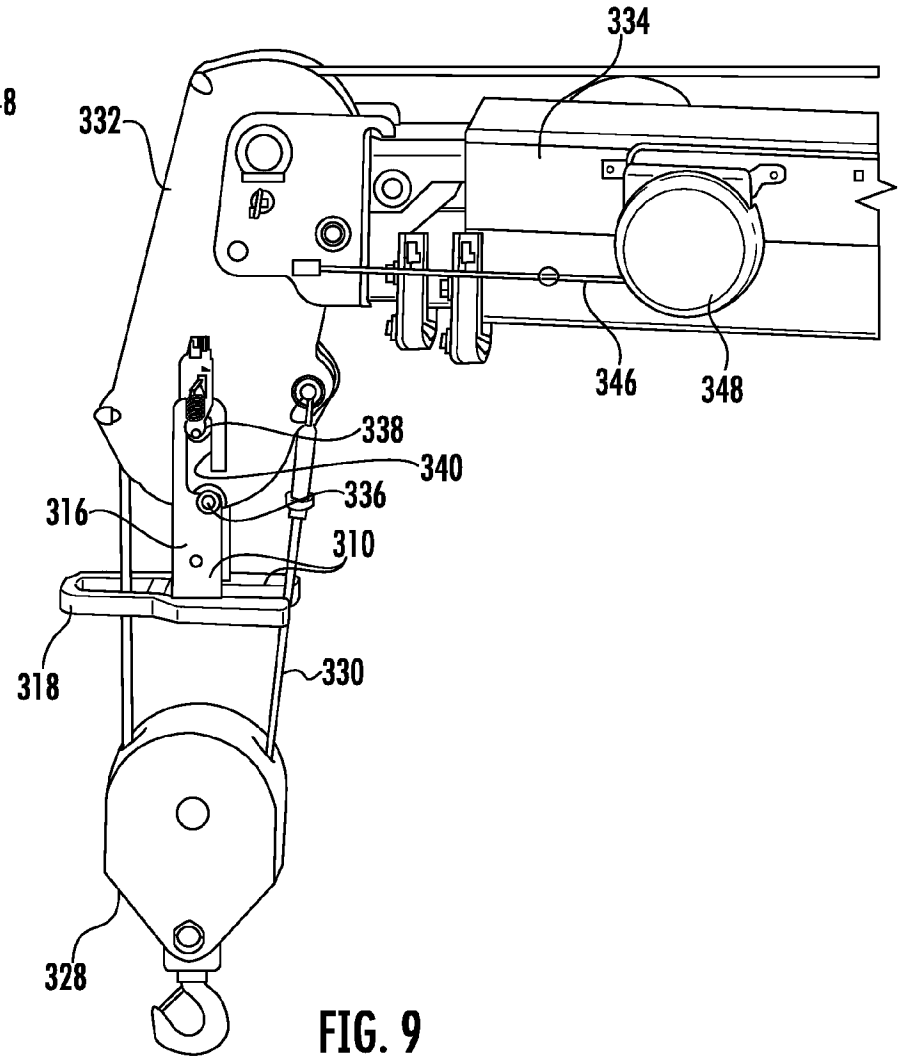
FIGS. 8-9 are left side views of an end of a crane in a first configuration according to exemplary embodiments of the invention.
Figure 8:
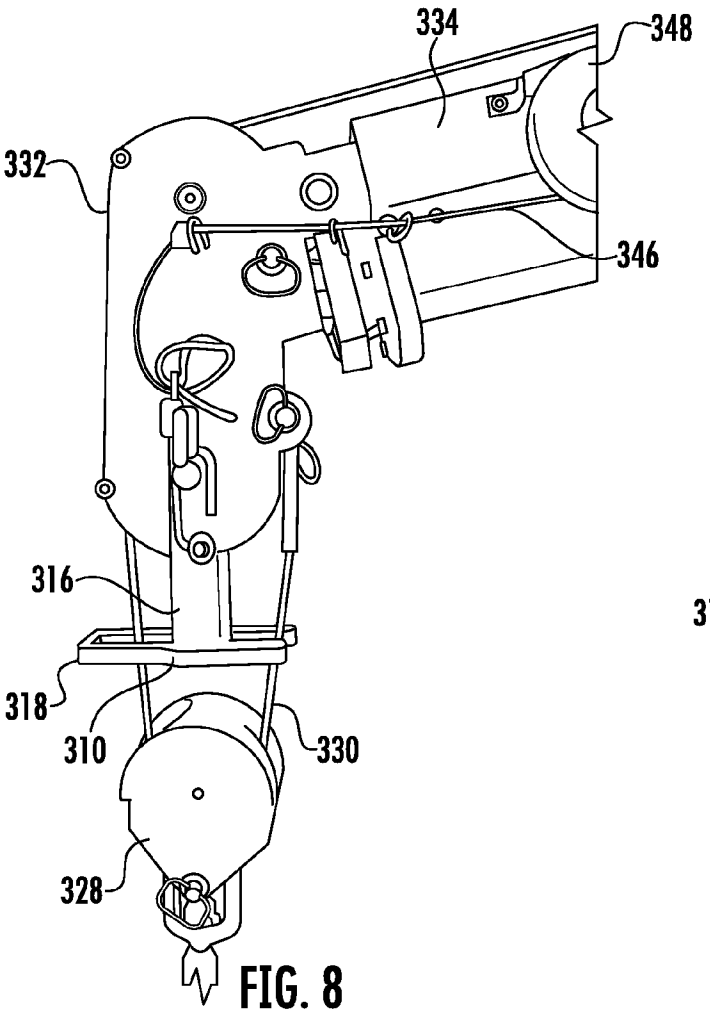

Referring now to FIGS. 8-9, gravity directs the base 318 of the body 310 of the anti-two block system such that the base 318 is substantially parallel with the ground (e.g., horizontal) and the extensions 316 are substantially orthogonal to the ground. Because the weight of snatch block 328 pulls the cable 330 from the distal end 332 of the boom 334 downward, the base 318 of the body 310 of the anti-two block system is substantially orthogonal to the cable 330 between the distal end 332 of the boom 334 and the snatch block 328. Further, the extensions 316 of the anti-two block system are positioned between and substantially aligned with the portions of the cable 330 between the distal end 332 of the boom 334 and the snatch block 328.

During operation of the crane assembly (see, e.g., crane assembly 112 as shown in FIGS. 1-3), as the boom 334 of the crane assembly rotates (e.g., raises and lowers the distal end 332), gravity acts upon the body 310 of the anti-two block system, to align the body 310 with the cable 330 and snatch block 328, regardless of the orientation of the boom 334. In some embodiments, a sliding member 336 (e.g., Teflon knob, guide) laterally constrains the body 310, as the body 310 rotates about a pin 338 of the sheave (see, e.g., sheave 220 as shown in FIG. 6) of the distal end 332 of the boom 334.

According to an exemplary embodiment, the body 310 of the anti-two block system is coupled to the pin 338 of the sheave on an outside of the housing of the distal end 332 of the boom 334. In some embodiments, the extensions 316 of the body 310 include a hook 340 or elongate opening allowing for a single degree of freedom in rotation about the pin 338 and a single degree of freedom in translation of the body 310 of the anti-two block system relative to the pin 338 of the sheave. As such, the body 310 is able to rotate to maintain alignment of the body 310 with the cable and snatch block, regardless of movement of the boom 334. Further, the body 310 is able to translate a limited amount in response to contact from the snatch block 328 upon the underside of the base 318 of the body 310 of the anti-two block system. Use of a hook 340 allows for attachment and removal of the body 310 from the pin 338 via the opening at the end of the hook 340.

Figure 11:
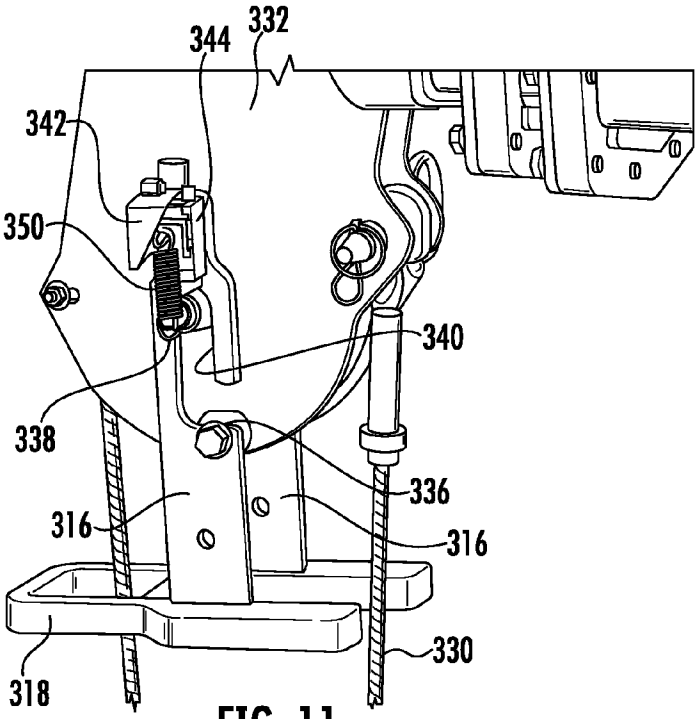
FIGS. 10-11 are perspective views of anti-two block systems of the cranes of FIG. 8-9.
Figure 10:
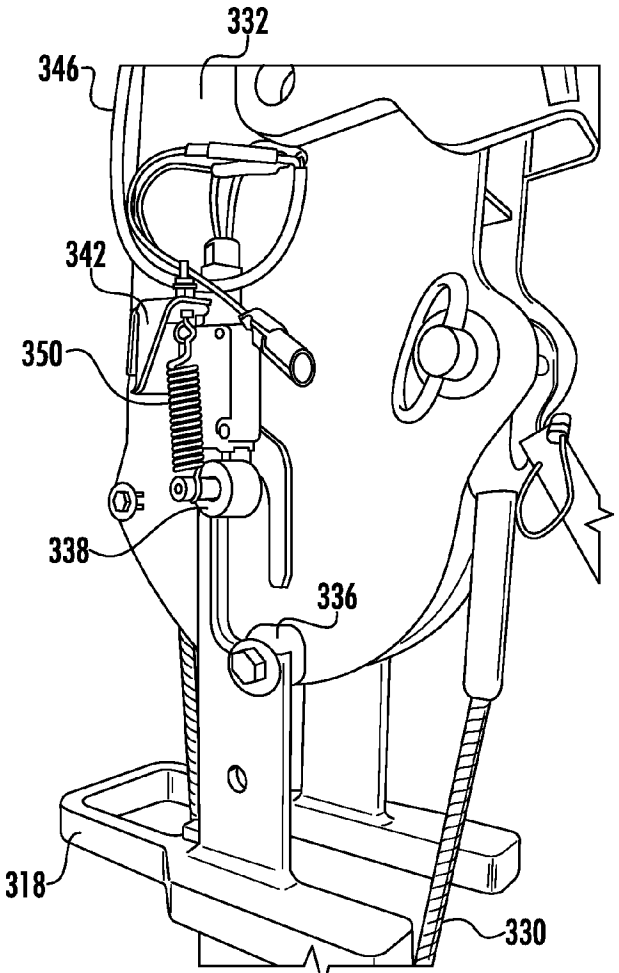

Referring to FIGS. 10-11, the body 310 of the anti-two block system includes a structure 342 (e.g., bracket, frame) for receiving a sensor 344 (see also FIG. 7). According to an exemplary embodiment, the sensor 344 is configured to detect at least one of loading, movement, pressure, relative displacement, strain, motion, etc. between the body 310 of the anti-two block system and a portion of the distal end 332 of the crane assembly, such as the pin 338 of the sheave. If the snatch block 328 (FIG. 8) travels up to contact the underside of the base 318 of the anti-two block system, then upward force applied by the snatch block 328 will be transferred through the rigid structure of the body 310 to the sensor 344. The sensor 344 then communicates a signal (e.g., electrical signal, radio-frequency signal, mechanical signal, hydraulic signal) to a controller (e.g., computer, control mechanism, processor (with or without memory), etc.), which limits the operation of the crane assembly to prevent the hoist from pulling the snatch block 328 against the distal end 332 of the boom 344. In at least one embodiment, the sensor 344 is a switch that opens or closes a circuit when the snatch block 328 contact the base 318 of the body 310 of the anti-two block system.

According to an exemplary embodiment, the structure 342 for receiving the sensor 344 on the body 310 of the anti-two block system is integrated with the body 310 such that rotation of the body 310 rotates the sensor 344. In some such embodiments, the sensor 344 extends between the structure 342 of the body 310 and the pin 338 of the sheave on the distal end 332 of the boom 334, which remain a fixed distance apart from one another regardless of the orientation of the boom 334, cable 330, and body 310 of the anti-two block system. However, the distance may change when the snatch block 328 contacts the underside of the body 310, which is detected by the sensor 344 and relayed to the controller.

Referring to FIGS. 8 and 10, a wire 346 (e.g., line, cable) from the sensor is coupled to the controller by way of an automatic rewind reel 348, which allows the wire 346 to extend as extensions of the boom 334 telescope outward to an operational configuration (see FIGS. 2 and 4). The reel 348 then automatically retracts the wire 346 when the extensions of the boom 334 telescope back to a stored configuration (see FIG. 1).

Referring again to FIGS. 10-11, in some embodiments the structure 342 for receiving the sensor 344 on the body 310 of the anti-two block system further includes a connector for a spring 350 or other biasing member. In some embodiments, the spring 350 pulls the structure 342 of the body 310 of the anti-two block system toward the pin 338 of the sheave, which holds the hook, loop, carabiner, or other fitting (e.g., connector, coupling) onto the pin 338 of the sheave. In other contemplated embodiments, a spring in the form of a torsion spring or flexible beam is coupled on the open end of the hook 340 below the pin 338 of the sheave.

Figure 12:
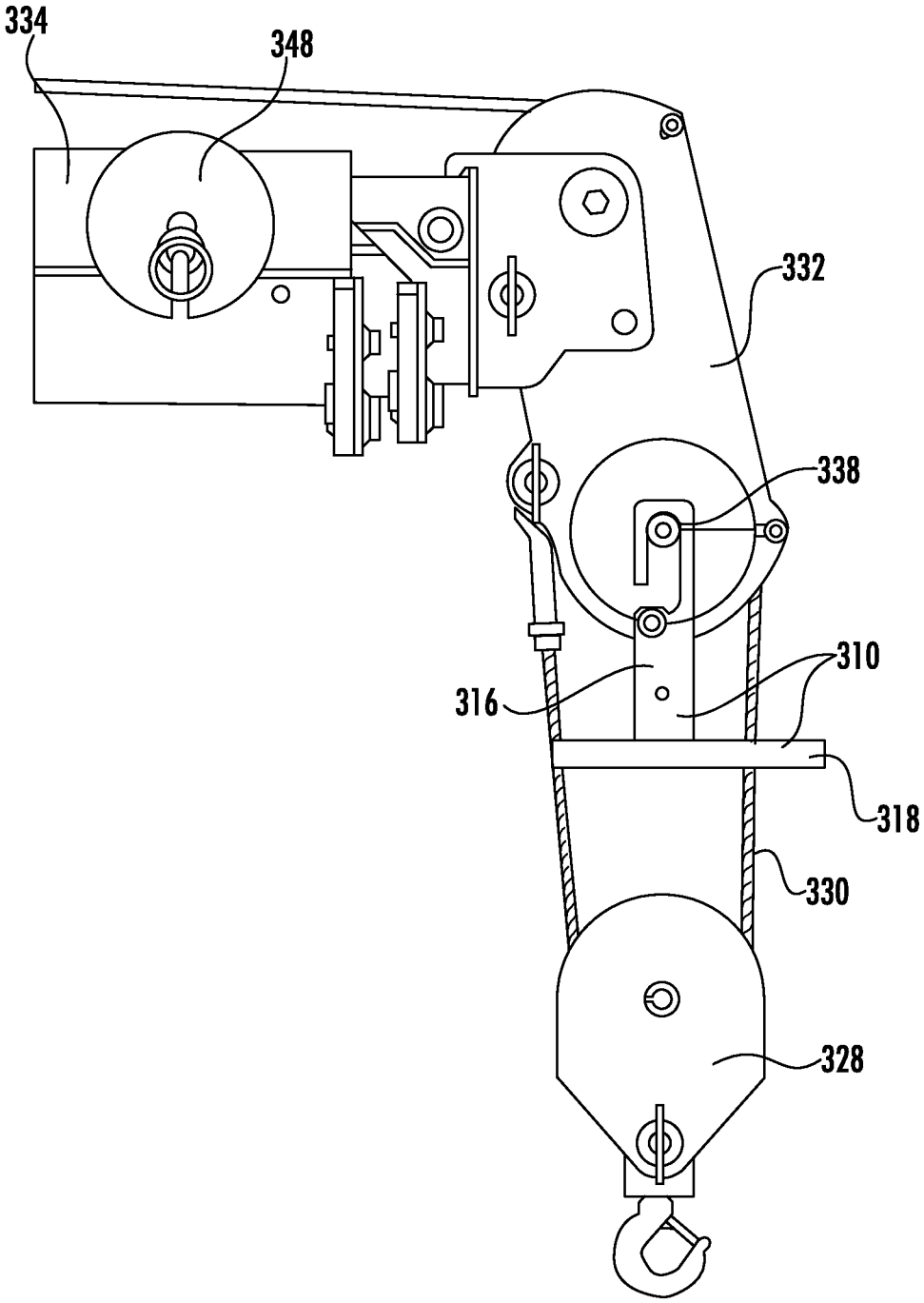
FIGS. 12-13 are right side views of an end of a crane according to an exemplary embodiment of the invention.
Figure 14:
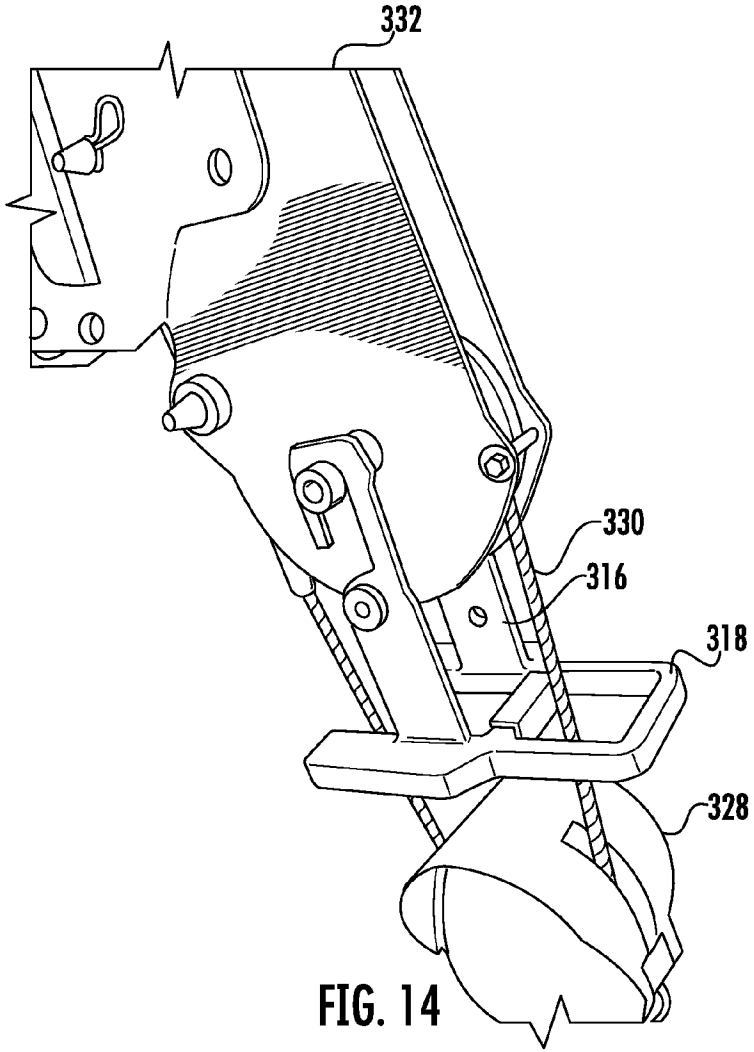
FIG. 14 is a perspective view of the end of the crane of FIG. 8.
Figure 13:
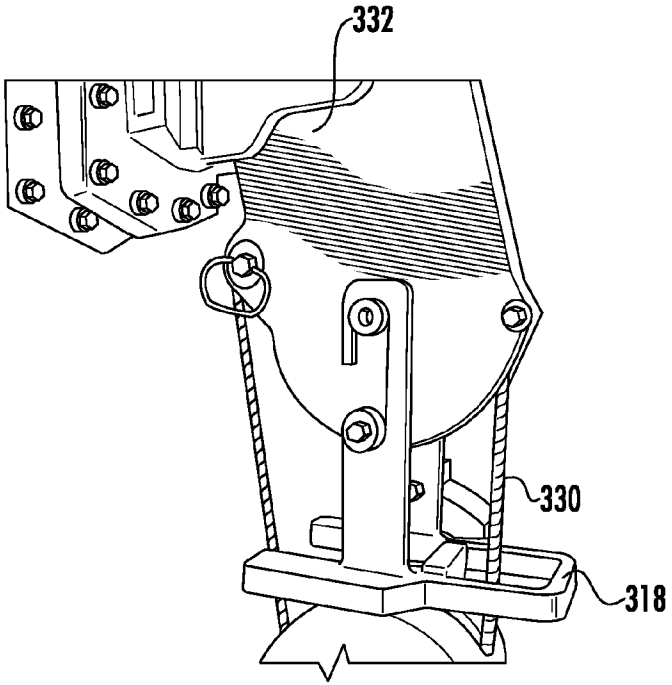

Referring to FIGS. 12-14, the opposite side of the distal end 332 of the boom 334 relative to the side shown in FIGS. 8-11 includes the extension 316, which is coupled to the pin 338 of the sheave. According to an exemplary embodiment, the extension 316 of the side shown in FIGS. 12-14 does not include the sensor 344, spring 350, or supporting structure 342. In other embodiments, a sensor, spring, and supporting structure are positioned on the right side of the distal end 332 of the boom 334, instead of the left side (FIGS. 8-11), or on both sides.

Figure 15:
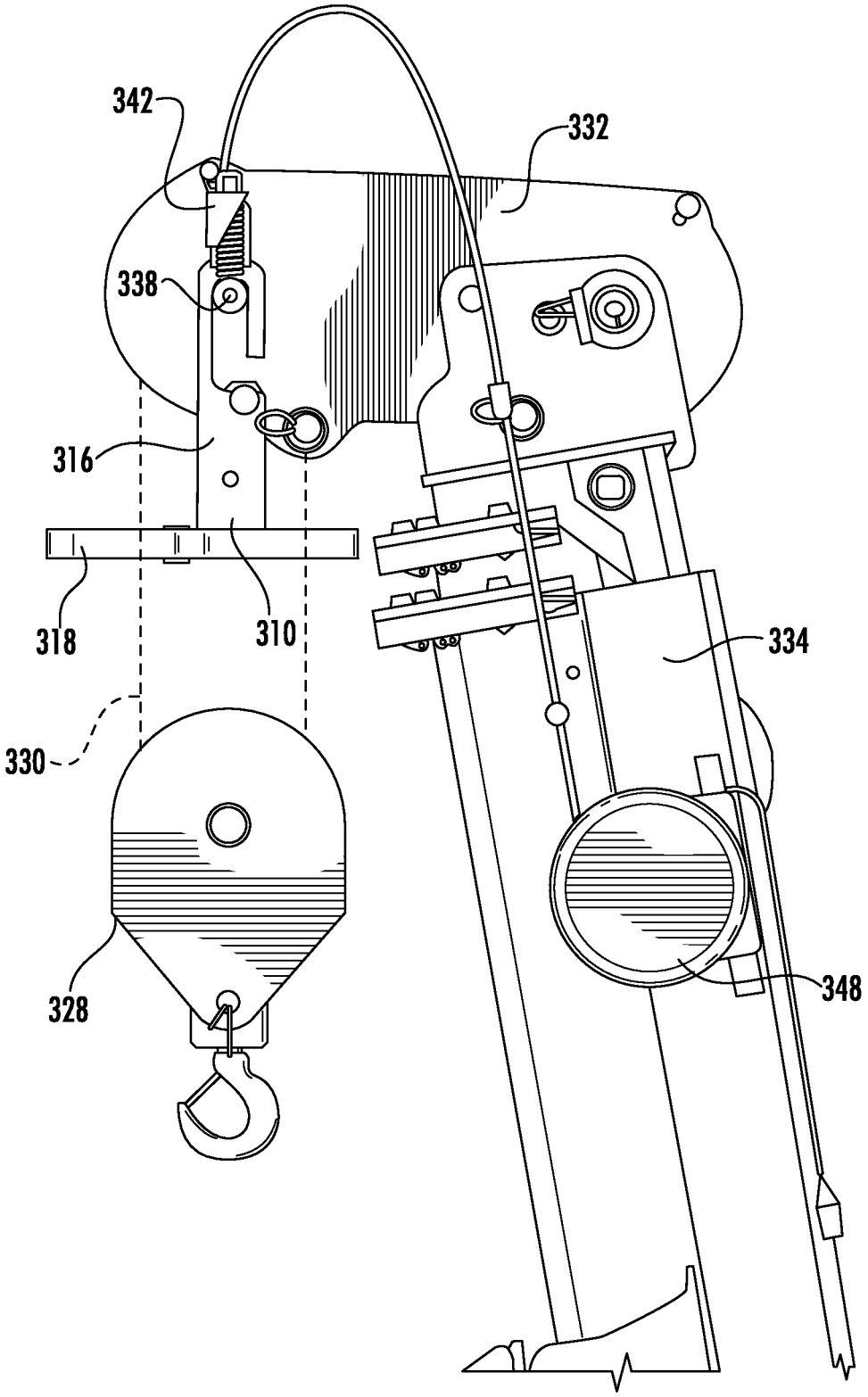
FIG. 15 is a left side view of the end of the crane of FIG. 9 in a second configuration.

Referring to FIG. 15, the boom 334 is oriented in a near vertical position, with the cable 330 between the distal end 332 of the boom 334 and the snatch block 328 almost parallel with the boom 334. The body 310 of the anti-two block system is rotated such that the base 318 is substantially horizontal and the extensions 316 are substantially vertical. The base 318 is sized to avoid contact with the stiffening plates (see also stiffening plates 140 as shown in FIG. 3) or other portions of the boom 334. Compared to the orientation of the anti-two block system as shown in FIG. 8, the body 310 has rotated at least 90-degrees in FIG. 15. In some embodiments, the body 310 is configured to rotate about 180-degrees or more.

Figure 16:
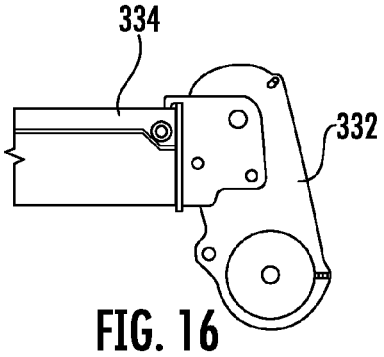
FIG. 16 is a side view of an end of a crane in a first configuration.
Figure 17:
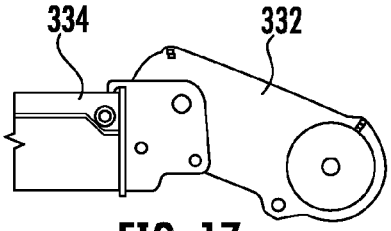
FIG. 17 is a side view of the end of the crane of FIG. 16 in a second configuration.
Figure 18:
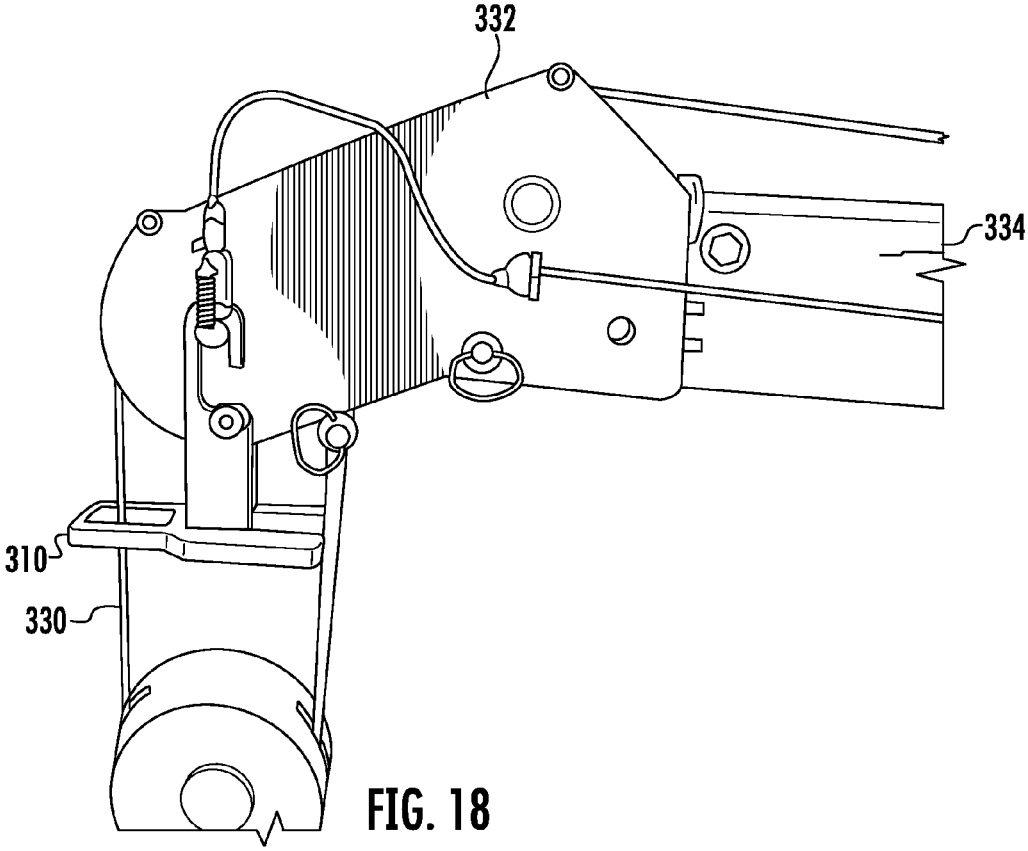
FIG. 18 is left side view of the end of the crane of FIG. 8 in a second configuration.
Figure 19:
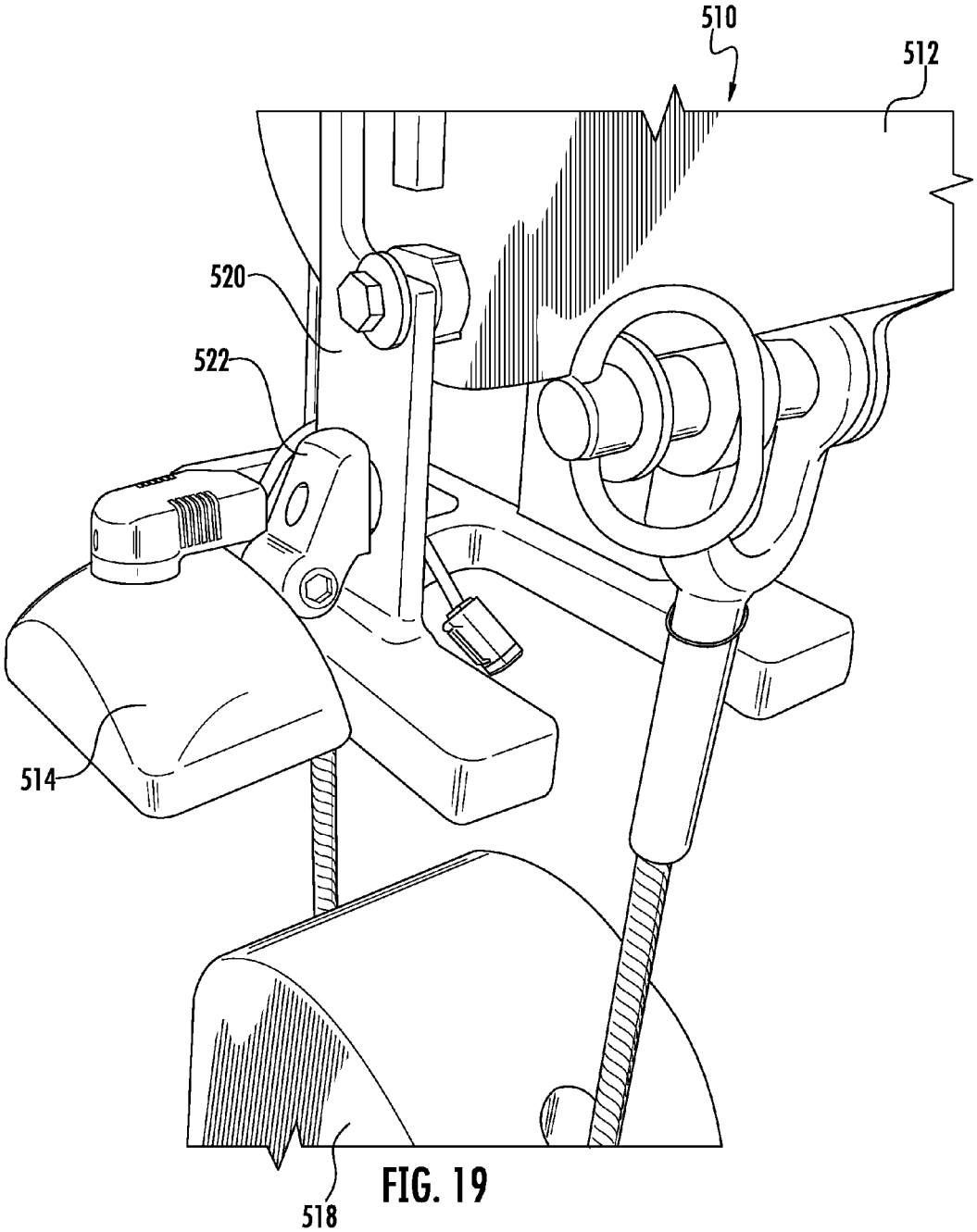
FIG. 19 is a perspective view from above of an anti-two block system according to another exemplary embodiment of the invention.
Figure 20:
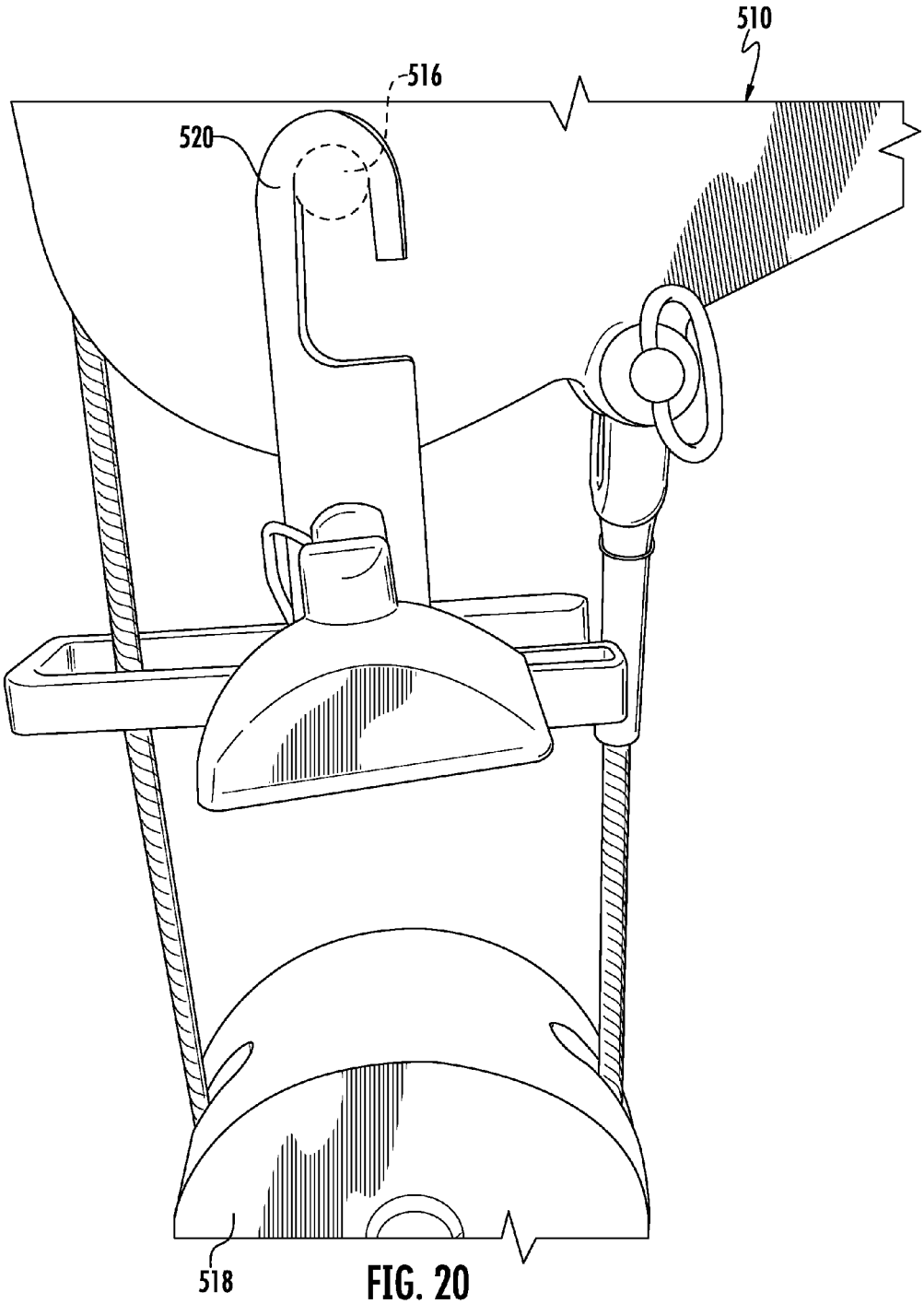
FIG. 20 is a side view of the anti-two block system of FIG. 19.
Figure 21:
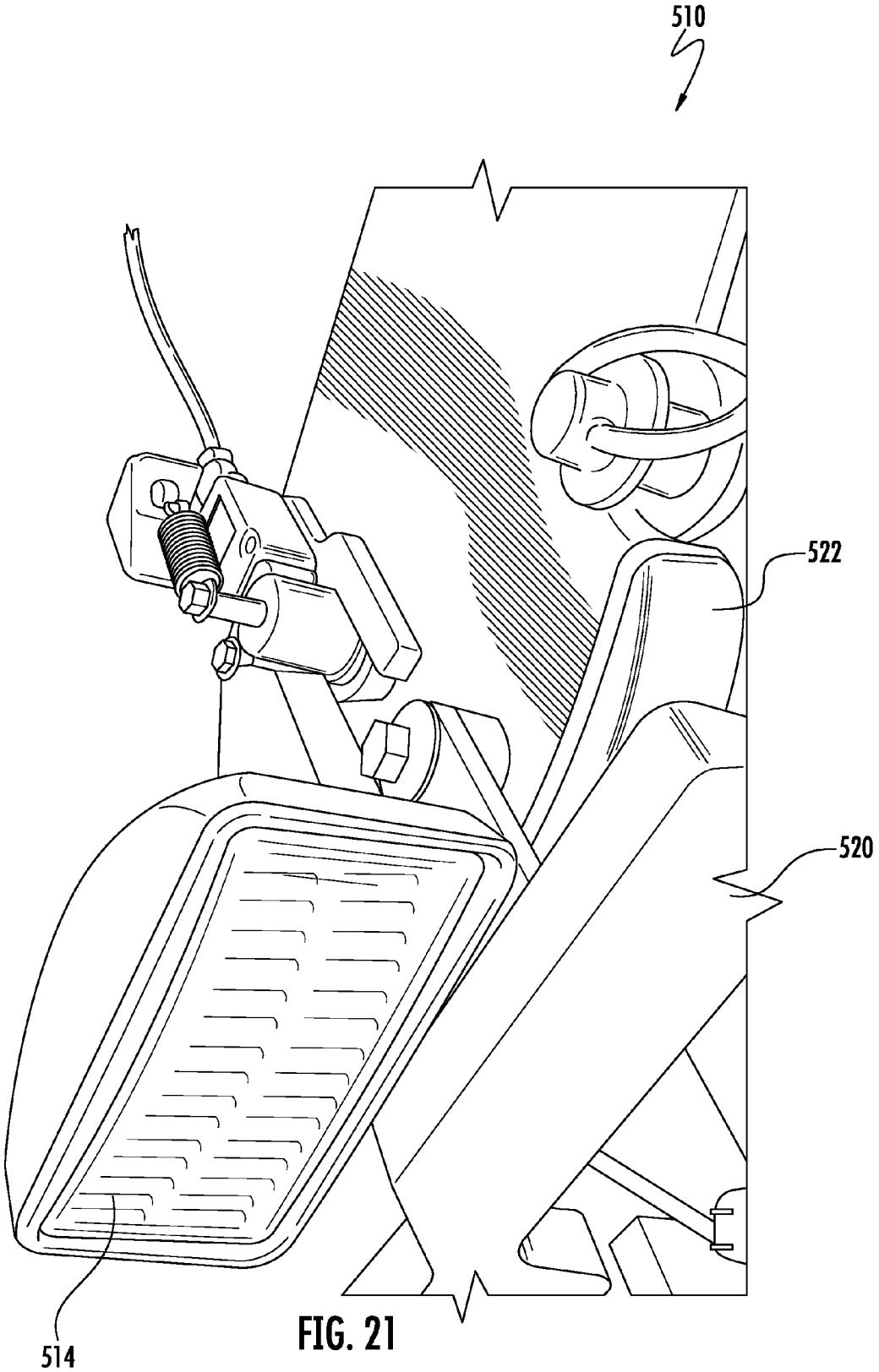
FIGS. 21-22 are perspective views from below of the anti-two block system of FIG. 19.
Figure 22:
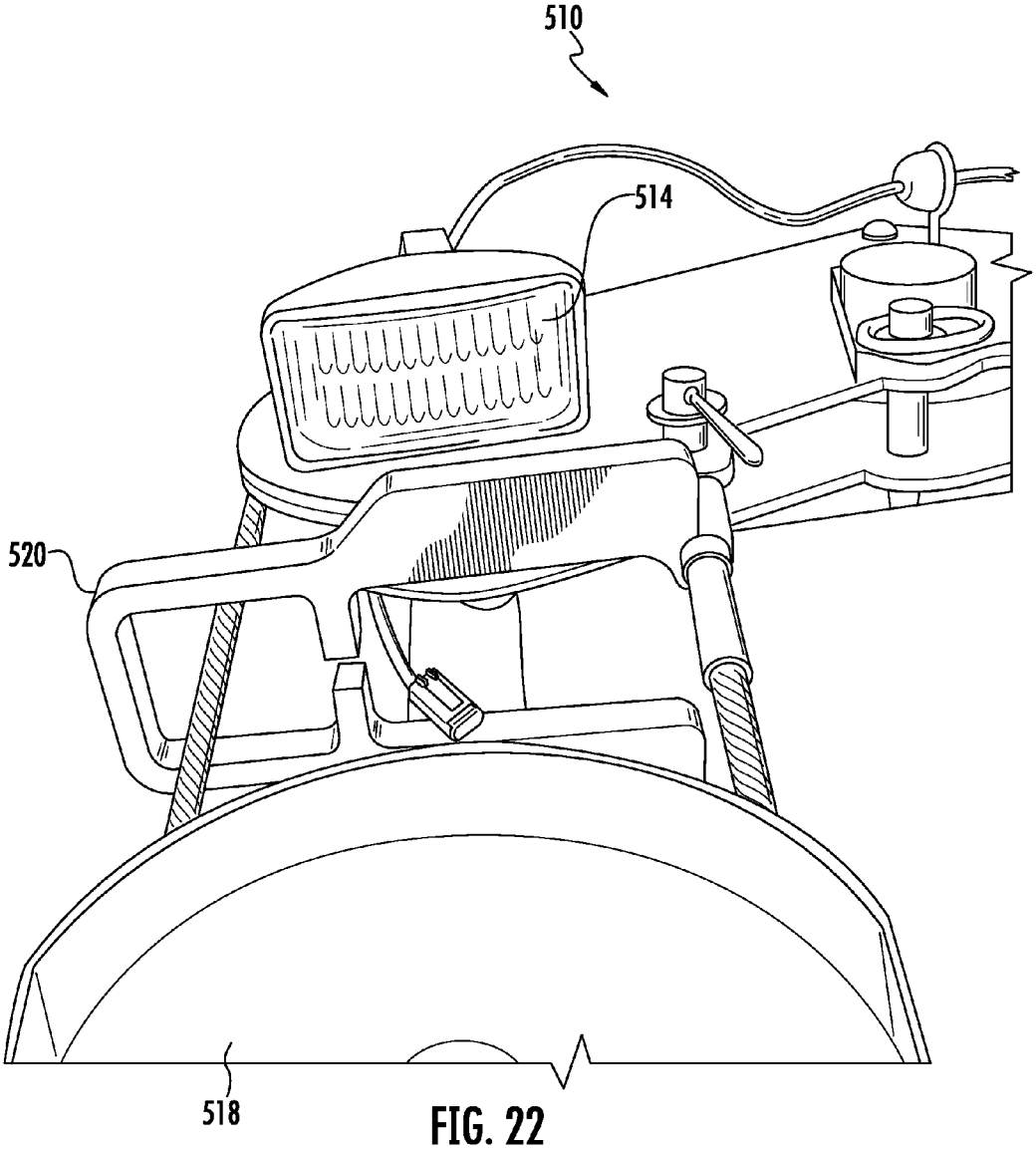

Referring now to FIGS. 16-18, the distal end 332 of the boom 334 is configured to operate in a normal mode (FIG. 16) and a "flip sheave" mode (FIGS. 17-18). In the normal mode, the distal end 332 of the boom 334 is angled downward, roughly orthogonal to the boom 334. In the "flip sheave" mode, the distal end 332 of the boom 334 is angled upward, roughly parallel with the boom 334. Operation of the crane assembly in the "flip sheave" mode may facilitate operation of the boom 334 through windows, doors, or other relatively confined spaces. Regardless of the configuration of the distal end 332 of the boom 334 (e.g., horse head), the body 310 (FIG. 18) of the anti-two block system is automatically aligned by gravity with the cable 330.

Referring to FIGS. 19-22, a crane assembly 510 includes a light 514 fastened to the boom 512. According to an exemplary embodiment, the light 514 is coupled to the pin 516 (FIG. 20) of the sheave 522 (FIG. 21) on the distal end of the boom 512, and is free to rotate about the pin 516. Gravity orients the light toward the snatch block 518 (or other tool) of the crane assembly, regardless of the orientation of the boom 512. As such, the light 514 is automatically directed, without use of controls, active motors, or other actuators.

According to an exemplary embodiment, the light 514 serves to illuminate the top surface of cargo to be hauled by the crane assembly 510 (see also FIGS. 2 and 4), which may include attachment structure for a hook of the snatch block 518. The light 514, which may be downward facing, may better illuminate the attachment structure of cargo and the hook of the snatch block 518 than a horizontal light from a main body of the crane assembly 510, such as if a portion of the cargo blocks the horizontal light.

According to an exemplary embodiment, the light 514 of the crane assembly 510 is coupled to the body 520 of an anti-two block system. In some such embodiments, the light 514 is fastened to extensions or the base of the body 520. The light 514 moves as the body 520 of the anti-two block system automatically rotates to orient the body 520 relative to the snatch block 518. In some embodiments, the light 514 is coupled to the body 520 of the anti-two block system by way of an adjustable joint. In contemplated embodiments, two or more lights are used. The lights may be integrated with the underside of the base of the body 520 of the anti-two block system. In some embodiments, light-emitting diodes are used, while in other embodiments traditional bulbs are used.

The construction and arrangements of the crane assembly, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

The present disclosure contemplates methods, systems and program products on memory or other machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products or memory comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

What is claimed is:

1. A crane assembly, comprising:

a boom, a cable, and a hook coupled to an end of the boom by the cable on a sheave, wherein the crane assembly is configured for lifting items via the hook;

an anti-two block system, comprising:

(A) a body that is rigid, comprising:

(i) a base having a surface for receiving the hook;

(ii) two extensions projecting upward from the base, perpendicular thereto, wherein the extensions extend outside the sheave on opposite sides thereof; and (iii) a fitting on upper ends of the extensions, wherein the fitting couples to a pin of the sheave such that the body is configured to rotate about the pin that the sheave rotates about;

(B) a sensor configured to detect upward loading of the body of the anti-two block system relative to a portion of the end of the boom; and (C) a spring biasing the body of the anti-two block system to the pin;

wherein the weight of the body of the anti-two block system rotates the body such that the extensions are substantially aligned with the cable between the end of the boom and hook as the boom rotates; and a controller comprising logic configured to prevent movement of the hook in response to a signal from the sensor of the anti-two block system.

2. The crane assembly of claim 1, further comprising a light coupled to the body of the anti-two block system and directed downward.

3. The crane assembly of claim 1, wherein the body is configured to rotate about the pin by more than 90-degrees.

4. The crane assembly of claim 3, further comprising a sliding member configured to laterally constrain the body as the body rotates about the pin.

5. The crane assembly of claim 1, wherein the anti-two block system is configured to operate in normal and flip-sheave modes.

6. The crane assembly of claim 1, wherein the body is configured to self stow with the hook.

7. The crane assembly of claim 1, wherein the portion of the end of the boom relative to which the sensor is configured to detect upward loading of the body of the anti-two block system is the pin of the sheave.

8. The crane assembly of claim 1, wherein the anti-two block system comprises a structure for receiving the sensor.

9. A crane assembly, comprising:

a boom, a cable, and a hook coupled to an end of the boom by the cable on a sheave, wherein the crane assembly is configured for lifting items via the hook; and an anti-two block system, comprising:

(A) a rigid body, comprising:

(i) a base;

(ii) a pair of extensions projecting perpendicularly upward from the base, wherein the extensions extend outside the sheave on opposite sides thereof; and (iii) a fitting on upper ends of the extensions, wherein the fitting couples to a pin of the sheave such that the body is configured to rotate about the pin;

(B) a sensor configured to detect upward loading of the body of the anti-two block system relative to a portion of the end of the boom; and (C) a spring biasing the body of the anti-two block system to the pin;

wherein the weight of the body of the anti-two block system rotates the body such that the extensions are substantially aligned with the cable between the end of the boom and hook as the boom rotates.

10. The crane assembly of claim 9, further comprising a controller comprising logic configured to prevent movement of the hook in response to a signal from the sensor of the anti-two block system.

11. The crane assembly of claim 9, wherein the body is configured to rotate about the pin by more than 90-degrees.

12. The crane assembly of claim 11, further comprising a sliding member configured to laterally constrain the body as the body rotates about the pin.

13. The crane assembly of claim 9, wherein the portion of the end of the boom relative to which the sensor is configured to detect upward loading of the body of the anti-two block system is the pin of the sheave.

14. The crane assembly of claim 9, wherein the anti-two block system comprises a structure for receiving the sensor.

15. A crane assembly comprising an anti-two block system, the anti-two block system comprising:

(A) a rigid body, comprising:

(i) a base;

(ii) a pair of extensions projecting perpendicularly outward from the base, wherein each extension is configured to extend outside a side of a sheave of a boom of the crane assembly; and (iii) a fitting on an upper end of each of the extensions, wherein the fitting couples to a pin of the sheave such that the body is configured to rotate about the pin;

(B) a sensor configured to detect upward loading of the body of the anti-two block system relative to an end of the boom; and (C) a spring biasing the body of the anti-two block system to the pin;

wherein the weight of the body of the anti-two block system rotates the body such that the extensions are substantially aligned with a cable of the crane assembly between the end of the boom an a hook of the crane assembly as the boom rotates.

16. The crane assembly of claim 15, further comprising a controller comprising logic configured to prevent movement of the hook in response to a signal from the sensor of the anti-two block system.

17. The crane assembly of claim 15, wherein the body is configured to rotate about the pin by more than 90-degrees.

18. The crane assembly of claim 17, further comprising a sliding member configured to laterally constrain the body as the body rotates about the pin.

19. The crane assembly of claim 15, wherein the sensor is configured to detect upward loading of the body of the anti-two block system relative to the pin of the sheave.

20. The crane assembly of claim 15, wherein the anti-two block system comprises a structure for receiving the sensor.

* * * * *